United States Patent [19]

Schmidt

[11] 4,199,111

[45] Apr. 22, 1980

[54] BEATER MILL

[75] Inventor: Martinus T. Schmidt, Kolding, Denmark

[73] Assignee: Schmidt & Sonner Maskinfabrik A/S, Kolding, Denmark

[21] Appl. No.: 924,663

[22] Filed: Jul. 14, 1978

Related U.S. Application Data

[62] Division of Ser. No. 703,242, Jul. 7, 1976, Pat. No. 4,101,080.

[30] Foreign Application Priority Data

Jul. 11, 1975 [DK] Denmark ..... 3174/75
Jul. 11, 1975 [DK] Denmark ..... 3176/75
Jun. 24, 1976 [DK] Denmark ..... 2841/76

[51] Int. Cl.[2] ..... B02C 13/288

[52] U.S. Cl. ..... 241/55; 241/59; 241/73; 241/191

[58] Field of Search ..... 241/55, 47, 49, 50, 241/51, 56, 59, 73, 74, 89.2, 191–195

[56] References Cited

U.S. PATENT DOCUMENTS

| | | | |
|---|---|---|---|
| 2,033,757 | 3/1936 | Crites | 241/47 X |
| 2,248,640 | 7/1941 | Miller | 241/191 |
| 3,123,312 | 3/1964 | Palyi | 241/55 |

FOREIGN PATENT DOCUMENTS

| | | | |
|---|---|---|---|
| 251464 | 8/1948 | Fed. Rep. of Germany | 241/191 |

*Primary Examiner*—Mark Rosenbaum
*Attorney, Agent, or Firm*—Perry Carvellas

[57] ABSTRACT

A beater mill comprising a cylindrical housing which accomodates a rotor carrying at least two arcuately spaced groups of beaters, the beaters from group to group being axially offset, the cylindrical jacket of the housing being formed as a peripheral sectional screen, an axial inlet for material to be milled being provided adjacent the rotor axis, the rotor arms being formed as fan blades and the said inlet including a distributor means for the air and material taken in through the inlet.

4 Claims, 3 Drawing Figures

BEATER MILL

Figure 2:
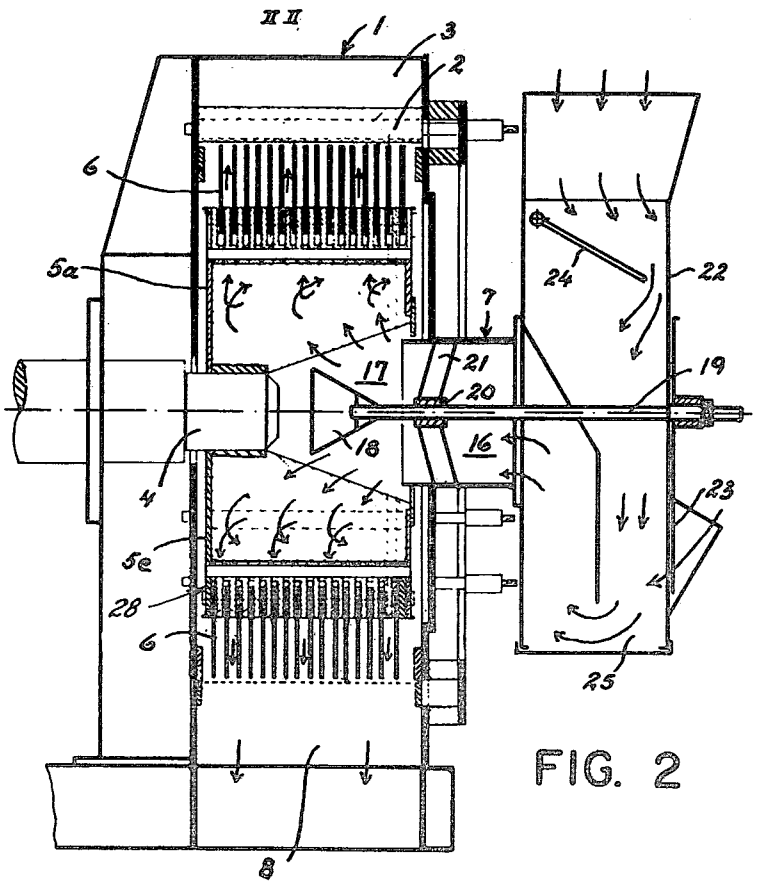

This is a division of application Ser. No. 703,242, filed July 7, 1976, which issued on July 18, 1978 as U.S. Pat. No. 4,101,080.

The present invention relates to a beater mill comprising a housing having a cylindrical milling chamber which accommodates a rotor carrying at least two arcuately spaced groups of beaters.

It is the object of the invention to provide a beater mill which is distinguished by a high milling output and the delivery of a practically uniform milled product coupled with a lower power consumption and noise level.

According to the invention, this object is achieved by the combination that the beaters from group to group are offset, that the cylindrical jacket of the chamber is formed as a peripheral screen, that an axial inlet for material to be milled is provided adjacent the rotor axis, that the rotor arms are formed as ventilator or fan blades and that the said inlet includes a distributor means.

Beaters arranged in axially offset groups are known. It is likewise known to form the jacket of the chamber as a circumferential screen. Finally, it is a known principle in mills to introduce the material to be milled at the centre of the rotor.

However, heretofore no attempt has been made to combine these known elements into a single mill. They have been used separately and not more than two at a time in connection with a beater arrangement or an embodiment of the jacket of the chamber or a location of the inlet for materials different from that selected according to the invention.

The invention is based on the recognition that the combination of these very features, unlike numerous other possible and practically employed combinations, provides quite substantial improvement of the milling output coupled with sharply reduced power consumption and generation of noise. The combination specifically suggested according to the invention does, in fact, cause the mill to operate in a unique manner.

The offset arrangement of the beaters precludes the risk of "slicing" of the material processed, which means that the material is effectively disintegrated without any appreciable formation of very fine meal. At the same time, the configuration of the arms as fan blades provides a high carrying effect. According to the invention, care has now been taken to utilize effectively this carrying effect since, by forming the entire jacket of the chamber as a screens it is achieved that milled material may leave, by the shortest path, the chamber enclosed by the jacket and in which the rotor operates. This, in turn, has the effect of building up in the milling chamber a strong pressure effect with corresponding vacuum effect in the inlet. This in turn, affords the possibility of feeding the material axially towards the centre of the rotor, which produces substantially less dust and noise than the frequently-employed feeding of material from above into the chamber. From the centre of the rotor the material is propelled to the peripheral region of the milling chamber where it is milled, as stated, and then removed.

The said distributor means makes it possible to control the inflow of air so as to provide good and even distribution of the incoming material across the axial extension of the ventilator blades with resultant optimum utilization of the effective area of the blades. This affords the possibility of obtaining satisfactory milling at a low rotational velocity of the rotor, which in turn means reduced generation of dust and noise.

It has been found, in comparison with known mills, that one obtains a substantial saving in power by forming the mill in accordance with the invention coupled with considerably reduced noise level. Besides, this embodiment of the mill provides a milled product which is substantially uniform with sharp edges and porous, too. Furthermore, the occurrence of fines or meal in the milled product may be substantially reduced in comparison with the milled products of other mills. These advantages may be of great importance when the mill is used for making pig feed, for example, as the feed is utilized more efficiently because meal in the feed requires greater quantities of liquid than feed with a low meal content.

According to the invention, the inlet may include a recessed passage which extends axially into the rotor from one side thereof and is defined over this length of penetration by the inlet end of the ventilator blades. The distributor means is disposed within or extending into said passage. This means that the distributor means will operate effectively within the rotor.

Advantageous flow conditions may be obtained in a simple manner by the recessed passage and the distributor means having in the axial direction unilaterally decreasing cross sections of opposite, converging orientation with respect to each other.

According to the invention, the distributor means may be substantially formed as a cone or similar object, e.g. a pyramid, and where the surface of the means may be continuous or interrupted. To allow adaptation of the beater mill to different type materials, the distributor means according to the invention may be adjustable.

According to the invention, the inflow of air may be further controlled by providing in the flow direction upstream of the inlet a vacuum box with adjustable air inlet openings to allow control of the inflow of air in connection with the distributor means, as desired. According to the invention, the vacuum box may also be adapted for separating entrained heavy particles such as stones, sand and pieces of metal.

For effectively removing the milled product, the screen may be surrounded by a discharge conduit for milled material.

According to the invention, the screen itself may be composed of a plurality of screen units and having a fixed curvature corresponding applying to the jacket of the chamber and, at the same time, adapted to be releasably positioned in the housing. This makes possible not only easy exchange of worn down screens but also swift and easy replacement of one or more or all of the screen units by units of different mesh or size of openings, which may be advantageous in milling special products, e.g. for feeds.

According to the invention each screen unit may consist of a separate, structurally-rigid frame composed of opposing side elements which follow the curvature of the chamber, cross elements interconnecting said side elements, and a screen plate or screen netting arranged on the frame, the free end surfaces of the former extending beyond said cross elements of the frame, and the housing includes releasable retaining means for securing said end surfaces.

This means that there is no risk of the screen plate or screen netting losing, when released, more or less its configuration corresponding to the curvature of the housing. This enables another screen unit to be inserted in the housing without any further fitting, which, moreover, may be effected with extreme speed and reliability by the screen plate or screen netting being secured at its end surfaces to the housing outside the cross members of the frame element.

According to the invention, the retaining means may simply consist of means abutting the end surfaces and of clamping means such as eccentric members for clamping the end surfaces to the abutting means. According to the invention, the retaining connection may be combined with engaging means in the form of flanges associated with the cross elements of the frame for sliding engagement with grooves in the abutting means of the housing, whereby the screen is supported and guided by the flanged cross members during insertion into and removal from the housing, being secured after such insertion by way of the said eccentrics or other releasable retaining means.

Figure 1:
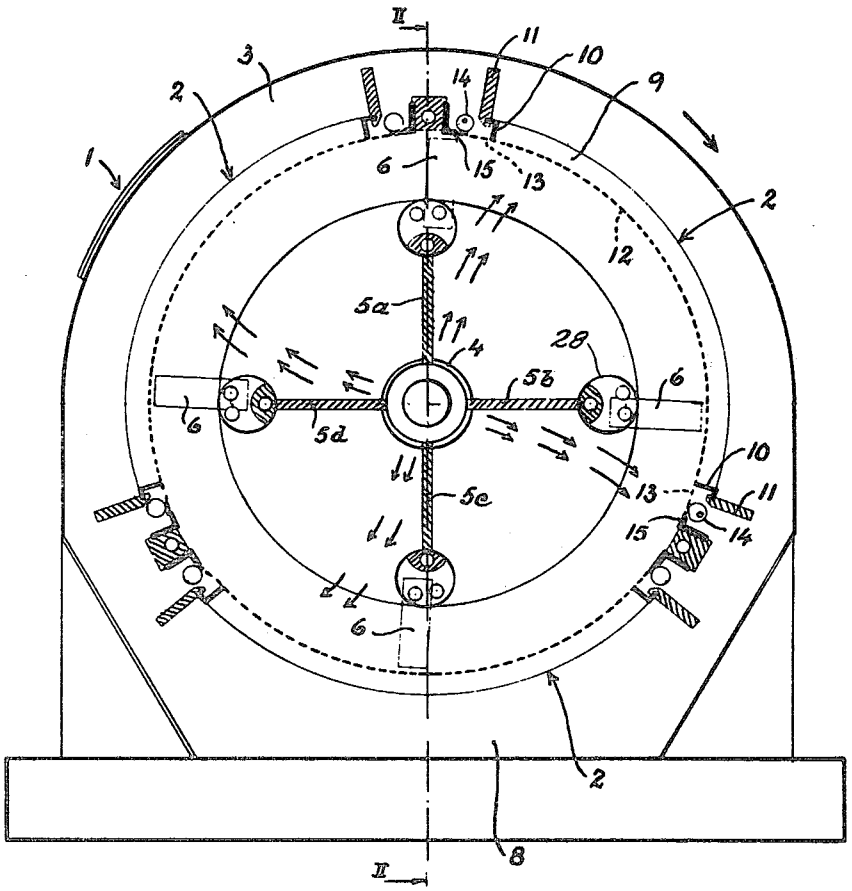
Figure 3:
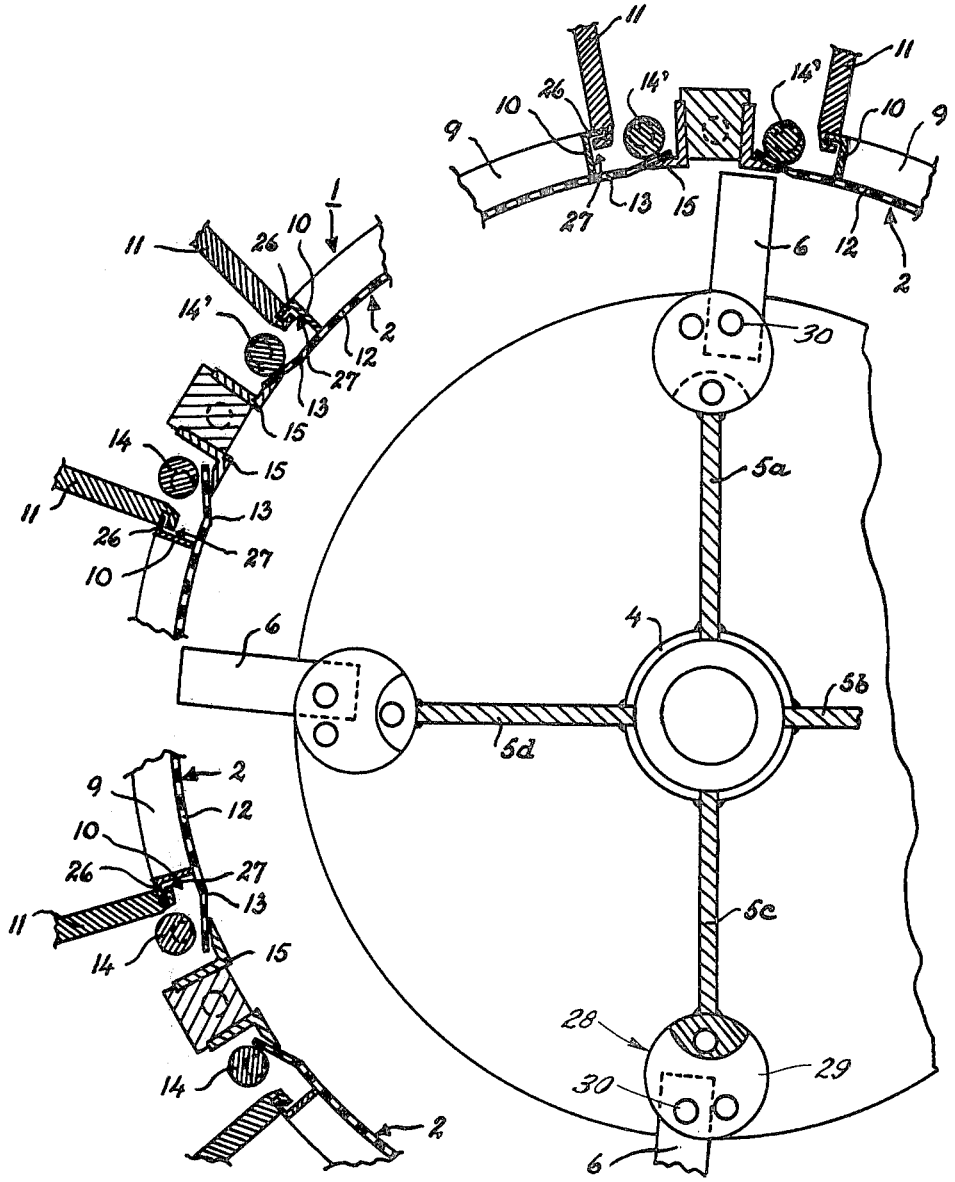

The invention will be further explained below with reference to the drawing, in which FIG. 1 is a schematic cross-sectional view of an embodiment of the beater mill according to the invention, FIG. 2 is an axial section of same taken along the line II—II of FIG. 1, and FIG. 3 is a cross section, on an enlarged scale, of part of the housing of a beater mill embodying a modified form of arrangement of screens sections according to the invention.

The beater mill illustrated in FIGS. 1 and 2 comprises a cylindrical housing 1 having a cylindrical jacket formed as a peripheral screen and composed of three sections or screen units 2. The screen is surrounded by a discharge conduit 3. The milling chamber enclosed by the screen accommodates a rotor 4 carrying four 90° arcuately spaced blades 5*a*, 5*b*, 5*c* and 5*d*, the extreme ends of which support beaters 6. In the embodiment shown the blades 5*a* and 5*b* form one group with identical arrangement of the beaters. However, the beaters of group 5*a*, 5*b* and group 5*c*, 5*d* are axially offset with respect to each other to sweep different, axially adjacent zones of the mill. The arrangement may also be that the blades 5*a* and 5*c* form one group. and the blades 5*b* and 5*d* another group, or each blade is taken as a separate group with similar axially offset arrangement of the beaters from group to group. An axial inlet 7 for material to be milled is arranged adjacent the rotary axis of the rotor. The lower end of the discharge conduit 3 terminates in an outlet 8.

Each screen unit 2 consists of a rigid frame with side members 9 following the curvature of the jacket, cross members 10 interconnecting said side members and in releasable engagement with a support means 11 of the housing. The frame 9, 10 is covered with a perforate screen plate or screen netting 12. End faces 13 of the plate or netting 12 extend beyond the cross elements 10 and, by means of clamping means in the form of eccentric members 14, the plate or netting is releasably clamped to abutting means 15 of the housing, said abutting means being in the form of angle irons.

The flow of material through the housing produced during operation of the beater mill is indicated by arrows. Fresh material introduced through the inlet 7 is propelled by the carrying effect produced by the blades 5 of the rotor 4 towards the periphery of the milling chamber proximate the screens 2, where the beaters 6 will mill or crush the material. Sufficiently milled or crushed material is rapidly discharged from the milling chamber through the screens 2 into the discharge conduit 3 and from there to the outlet 8.

The inlet 7 comprises partly a tubular inlet duct 16 extending into the housing 1, partly a recessed passage 17 extending axially into the rotor 4 from the right side thereof, and defined over this length by the tapering inlet end of the blades 5*a*, 5*b*, 5*c* and 5*d*. A conical distributor means 18 is arranged in the passage 17 which is likewise of conical cross-sectional configuration but with opposite, converging orientation in relation to the cone. The distributor means 18 is axially adjustable by means of a splindle 19 mounted in a sleeve 20 which by way of support means 21 is disposed in the tubular duct 16.

In the flow path upstream of the inlet duct 16, there is provided a vacuum box 22 with adjustable dampers 23 and 24 for adjustment of the volume of air required for various materials. The vacuum box 22 has a lower compartment 25 for collection of any heavy particles sorted out.

The arrows shown indicate that, by means of the distributor means 18, it is possible to provide an air flow which will distribute the arriving material across the axial extension of the blades 5*a*, 5*b*, 5*c* and 5*d* so as to utilize their entire effective area for conveyance of material.

Besides, the mill is constructed to allow optional change of the direction of rotation of the rotor.

According to the embodiment shown in FIG. 3 the entire jacket consists of six screen units 2.

The clamping means designated 14 appear in their released position while the clamping means designated 14' depict their locked position. The cross elements 10 have engaging means formed as projecting flanges 26 in sliding engagement with grooves 27 in the support members 11 of the housing 1.

A screen unit 2 is exchanged merely by loosening and moving the clamping means from position 14 to 14 and thereafter sliding the screen unit axially out from the housing via apertures (not shown). The work requires no further manipulations of the mill, and the same screen unit or another screen unit may then by insertion without any further adaptation to the cylindrical shape of the chamber be swiftly and safely secured by turning the clamping means from position 14 to 14'. During the operation the means 15 serve as an obstruction interrupting the screen area in the milling chamber to thereby offset too vigorous rotation of the milling material in the chamber.

The blades 5*a* through 5*d* are each provided with an abruptly enlarged portion 28 intermediate the flat portion of the blade and the beaters 6 carried thereon. The width of the enlarged portions 28 along the plane of rotation of the rotor is substantially greater than the corresponding width of the blade and of the beaters themselves and serves as an airstream deflecting member. Preferably, the abruptly enlarged portions 28 are generally cylindrical, with their axes parallel to the axis of the rotor, and have transverse slots 29 for receiving and mounting the beaters on pins 30.

What I claim is:

1. A beater mill comprising a cylindrical housing, a rotor mounted for rotation in said housing, said rotor including a hub and at least two fan blades arcuately spaced about the rotor axis, said fan blades each having a plurality of beaters thereon, the beaters of one of said fan blades being axially offset with respect to the beaters of another of said fan blades, said cylindrical housing including a peripheral screen area, the outer portions of said fan blades having an axial width corresponding to the width of said peripheral screen area, inlet means for delivering both air and solids to said housing coaxially with said rotor, and said fan blades being substantially flat and including an enlarged portion adjacent and closer to the rotary axis of the fan blades than the beaters and substantially wider as measured in the rotary plane than the width of said fan blades and said beaters.

2. The beater mill of claim 1 in which said enlarged portions are substantially cylindrical and include slots for mounting said beaters.

3. The beater mill of claim 1 wherein the inner portions of said fan blades have a reduced axial width and form an axial recess in said rotor.

4. The beater mill of claim 3 wherein said inlet means include an inlet duct terminating within said recess coaxially therewith, a distributor mounted within said recess coaxially with said inlet duct and said rotor and for axial adjustment relative to said rotor.

* * * * *